US006915180B2

(12) United States Patent
Sasaki

(10) Patent No.: US 6,915,180 B2
(45) Date of Patent: Jul. 5, 2005

(54) IDENTIFICATION METHOD FOR CROSS DIRECTIONAL POSITION CORRESPONDENCE AND MANUFACTURING EQUIPMENT USING THIS METHOD FOR SHEET FORM PRODUCTS

(75) Inventor: Takashi Sasaki, Musashino (JP)

(73) Assignee: Yokogawa Electronic Corporation, Tokyo (JP)

( * ) Notice: Subject to any disclaimer, the term of this patent is extended or adjusted under 35 U.S.C. 154(b) by 0 days.

(21) Appl. No.: 10/760,831

(22) Filed: Jan. 20, 2004

(65) Prior Publication Data

US 2004/0167657 A1 Aug. 26, 2004

(30) Foreign Application Priority Data

Feb. 24, 2003 (JP) ..... 2003-045717

(51) Int. Cl.[7] ..... G06F 7/66
(52) U.S. Cl. ..... 700/127; 700/128; 700/129
(58) Field of Search ..... 700/127, 128, 700/129, 117; 702/33, 150; 162/262

(56) References Cited

U.S. PATENT DOCUMENTS

| | | | | | |
|---|---|---|---|---|---|
| 5,812,404 | A | * | 9/1998 | Hamalainen et al. | 700/128 |
| 5,893,055 | A | * | 4/1999 | Chen | 702/189 |
| 6,421,575 | B1 | * | 7/2002 | Shakespeare | 700/127 |
| 6,564,117 | B1 | * | 5/2003 | Chen et al. | 700/129 |
| 6,647,312 | B2 | * | 11/2003 | Sasaki | 700/128 |
| 6,799,082 | B2 | * | 9/2004 | Sasaki | 700/128 |
| 6,799,083 | B2 | * | 9/2004 | Chen et al. | 700/128 |
| 6,807,510 | B1 | * | 10/2004 | Backstrom et al. | 702/150 |

FOREIGN PATENT DOCUMENTS

| | | |
|---|---|---|
| JP | 9316791 | 12/1996 |
| JP | 9049185 | 2/1997 |
| JP | 9132892 | 5/1997 |

OTHER PUBLICATIONS

Dumont et al. "An Improved algorithm for estimating paper machine moisture profiles using scanned data". Dec. 11–13, 1991. Proceedings of the conference on Decision and Control, 1991. Brighton, UK.*

Doyle et al. "Customization strategies for the solution of linear programming problems arising from large scale MP paper machine". Jun. 4–6, 1997. Proceedings of the American Control Conference, 1997. Albuquerque, NM USA.*

* cited by examiner

*Primary Examiner*—Leo Picard
*Assistant Examiner*—Alexander Kosowski
(74) *Attorney, Agent, or Firm*—Moonray Kojima

(57) ABSTRACT

The present invention solves the quality control problems that exist in manufacturing equipment for sheet form products, that is, although the position correspondence between actuators and measuring points has been measured and switched for every raw material recipe, it takes a lot of time and effort and if the position correspondence shifts during machine operation, the position correspondence must be measured again by measuring step responses.

According to the present invention, the position correspondence, interference width, and process gain of a process model are modified so that the deviation between the process model and the measured profile is minimized by inputting the manipulated variable of the actuators to the process model. This position correspondence is also set to a cross direction controller that outputs the manipulated variable. Since this enables the position correspondence to be modified in succession to the optimum value during machine operation, it prevents controllability from deteriorating even if the position correspondence shifts, thereby eliminating time and effort for measuring and switching position correspondences for each raw material recipe.

16 Claims, 8 Drawing Sheets

FIG.7

| Actuator number | Position correspond-ence in the model | Position correspond-ence in actu-al process | Process-model | Modification amount of position cor-respondence |
|---|---|---|---|---|
| 1 | 300 | 305 | 5 | 3.7 |
| 2 | 290 | 294.5 | 4.5 | 3.5 |
| 3 | 280 | 284 | 4 | 3.3 |
| 4 | 270 | 273.5 | 3.5 | 3.0 |
| 5 | 260 | 263 | 3 | 2.6 |
| 6 | 250 | 252.5 | 2.5 | 2.3 |
| 7 | 240 | 242 | 2 | 1.9 |
| 8 | 230 | 231.5 | 1.5 | 1.5 |
| 9 | 220 | 221 | 1 | 1.0 |
| 10 | 210 | 210.5 | 0.5 | 0.6 |
| 11 | 200 | 200 | 0 | 0.1 |
| 12 | 190 | 189.5 | −0.5 | −0.4 |
| 13 | 180 | 179 | −1 | −0.9 |
| 14 | 170 | 168.5 | −1.5 | −1.4 |
| 15 | 160 | 158 | −2 | −1.9 |
| 16 | 150 | 147.5 | −2.5 | −2.4 |
| 17 | 140 | 137 | −3 | −2.9 |
| 18 | 130 | 126.5 | −3.5 | −3.4 |
| 19 | 120 | 116 | −4 | −3.9 |
| 20 | 110 | 105.5 | −4.5 | −4.4 |
| 21 | 100 | 95 | −5 | −5.0 |
| 22 | 90 | 84.5 | −5.5 | −5.5 |
| 23 | 80 | 74 | −6 | −5.9 |
| 24 | 70 | 63.5 | −6.5 | −6.4 |
| 25 | 60 | 53 | −7 | −6.9 |
| 26 | 50 | 42.5 | −7.5 | −7.3 |
| 27 | 40 | 32 | −8 | −7.6 |
| 28 | 30 | 21.5 | −8.5 | −7.9 |
| 29 | 20 | 11 | −9 | −8.2 |
| 30 | 10 | 1 | −9 | −8.4 |

| | | | |
|---|---|---|---|
| Interference width in the model | 8 | Gain in the model | 0.7 |
| Interference width in actual process | 10 | Gain in actual process | 1.0 |
| Modification amount of interference width | 1.737 | Modification amount of gain | 0.272 |
| Modification step width of interference width | 10 | Modification step width of gain | 0.4 |

IDENTIFICATION METHOD FOR CROSS DIRECTIONAL POSITION CORRESPONDENCE AND MANUFACTURING EQUIPMENT USING THIS METHOD FOR SHEET FORM PRODUCTS

BACKGROUND OF THE INVENTION

1. Field of the Invention

The present invention relates to an identification method for cross directional position correspondence in equipment that manufactures sheet form products, in which the position correspondence between actuators for controlling cross direction profiles of the sheet and measuring points for these profiles can be automatically identified, and to manufacturing equipment using this method for sheet form products.

2. Description of the Prior Art

FIG. 1 shows a configuration of a portion to control cross direction profiles in the equipment for manufacturing sheet form products such as paper. Hereafter description will be made pertaining to paper manufacturing equipment. In FIG. 1, the raw material pulp is made into sheet form by being sent out to wire part 42 from the gap of slice lip 41. The width of the gap of slice lip 41 is adjusted by slice bolts 43. Moisture contained in the pulp which has been made into sheet form is removed during the time interval in which the pulp is carried in the direction of arrow 44 on wire part 42, and a profile of the thickness of the pulp is measured at BM frame 45.

Since the measuring interval at BM frame 45 is about 5 mm while distances between slice bolts 43 are 35 to 100 mm, two or more measuring points correspond to one slice bolt. Which measuring points correspond to which slice bolt cannot be determined with their geometrical relations only. For this reason, tuning for these position correspondences is carried out at machine start-up.

FIG. 2 shows the tuning flow for position correspondence. First, an automatic step response test is carried out, in which a step manipulated variable is given to the actuators (slice bolts 43) and a change in the cross direction profile corresponding to this manipulated variable is measured. This is performed, for example, using the technique mentioned in Japanese Laid-open Patent Application No. 9-316791.

Next, positions of measuring points corresponding to each actuator are individually determined by analyzing the results of this step response test. This method of determination is carried out, for example, using the technique mentioned in Japanese Laid-open Patent Application No. 9-049185. Finally total position correspondence, which settles position correspondences for all actuators, is determined by smoothly interpolating these individual position correspondences. This is carried out, for example, using a procedure mentioned in Japanese Laid-open Patent Application No. 9-132892.

During implementation of the automatic step response test, it is difficult to maintain good profiles because the number of manipulating bolts of the actuators and manipulated variables of the actuators are limited and thus it is difficult to implement the test during machine operation in view of quality control. Accordingly, the usual procedure is that position correspondence between the actuators and the measuring points is determined based on the flow shown in FIG. 2 at control start-up and this position correspondence is used in a fixed manner during machine operations.

However, determination of position correspondence between the actuators and the measuring points by such a method has the following problems:

When an automatic step response test is being implemented, tuning operators must continue to monitor the test. However, at times when there are many actuators, there can be from 100 to 200 of them. This results in the problem of a very great load being imposed on the tuning operators.

In addition, if a recipe for the sheet raw material changes, position correspondence also changes. For this reason, the usual procedure is that individual position correspondences are stored for each recipe and if a recipe is changed, the stored position correspondence is called up and re-set. However, there is also the problem that the position correspondence must be identified by implementing an automatic step response test for each recipe and considerable man hours become necessary for tuning work.

Further, if the machine operating conditions such as basis weight and machine speed or other production conditions change, position correspondence changes even if the raw material recipe remains the same, and the above determination method cannot cope with such cases. Thus there is also another problem with the above method in that controllability deteriorates resulting in the production of defective products.

Consequently, the objective of the present invention is to offer an identification method for cross directional position correspondence that can automatically determine and re-set position correspondence between the actuators and the measuring points during machine operation, and to provide manufacturing equipment using this method for sheet form products.

SUMMARY OF THE INVENTION

In order to solve these problems, claim 1 of the present invention provides an identification method for position correspondence, which identifies the position correspondence between the actuators for controlling the cross direction profile and the measuring points for measuring the above profile in manufacturing equipment for sheet form products that includes a plurality of actuators for controlling cross direction profiles of sheet form products and a cross direction controller which receives a target profile and a measured profile in the cross direction of the above sheet form products as inputs and sends out a manipulated variable that controls the above plurality of actuators. This method includes a step in which the manipulated variable sent out from the above cross direction controller is received and model calculation is carried out using a process model which simulates the process including the above plurality of actuators, a step in which the deviation between this model calculation output and the above measured profile is received and the optimum values for position correspondence, interference width, and process gain are calculated so that the above deviation is minimized, a step in which the resulting optimum values of position correspondence, interference width, and process gain are set to the position correspondence, interference width and process gain in the above process model, and a step in which the optimum value of the above position correspondence is set to the position correspondence in the above cross direction controller. Characteristic of the method is that these settings are performed with the same timing as control in the above cross direction controller or for a longer period. This enables the position correspondence to be modified during control in the cross direction.

In claim 2 of the present invention, the process model in claim 1 described above uses a normal distribution function as the cross direction profile response corresponding to the input manipulated variable. This empirically approximates profile responses well.

In claim 3 of the present invention, as the above cross direction profile response in claim 2 described above, a dead time and a first order lag response are added to the normalized distribution function. This results in a model for a more realistic process.

In claim 4 of the present invention, as the above cross direction profile response in claim 3 described above, the following equation (1) is employed. This results in a model for a more realistic process.

$$\text{Profile response}=K\cdot g(n)\cdot U_j(n) \quad (1)$$

Where $$g(n) = 1 - \exp\left(-\frac{nT_0 - L}{T}\right) \quad (\text{when } nT_0 > L)$$

$$g(n) = 0 \quad (\text{when } nT_0 \le L)$$

In the above equation, "K" is a process gain, "n" is the number of sampling periods from inputting of the manipulated variable to outputting of its profile response, "$T_o$" is a sampling period, "L" is a dead time, "T" is the time constant of the first order lag, and "$U_j$(n)" is the manipulated variable input n sampling periods before.

In claim 5 of the present invention, for calculation of the above optimum value in any of claims 1 to 4 described above, the above position correspondence modification amount is determined using the steepest descent method. This enables the solution to be obtained simply and rapidly.

In claim 6 of the present invention, for calculation of the above optimum value in claim 5 described above, the position correspondence modification amount determined by the above steepest descent method is interpolated with the interpolation calculation using a neural network. Dispersion of the position correspondence modification amount in the cross direction caused by the dispersion of the amount of control action can be smoothly interpolated.

In accordance with claim 7 of the present invention, in claim 5 described above, the specific limit values are set and the above modification amount is modified so that the above modification amount does not take a value outside the region within the limit values. This can give stability to the optimization.

According to claim 8 of the present invention, in claim 6 described above, the specific limit values are set and the above modification amount is modified so that the above modification amount does not take a value outside the region within the limit values. This can give stability to the optimization.

Claim 9 of the present invention provides manufacturing equipment for sheet form products that includes a plurality of actuators for controlling cross direction profiles of sheet form products, a cross direction controller which receives a target profile and a measured profile in the cross direction of the above sheet form products as the inputs and sends out a manipulated variable that controls the above plurality of actuators, a process model which receives the above manipulated variable as the input and simulates the process, and a position correspondence optimization portion to which the deviation between the output of the process model and the above described measured profile is input. This position correspondence optimization portion optimizes the position correspondence between the above plurality of actuators and the above plurality of measuring points and also optimizes the interference width of the above process model, so that the deviation between the outputs of the above process model and the above measured profile is minimized. It also sets the resulting position correspondence and interference width to the above process model, and sets the above position correspondence to the above cross direction controller. This enables the position correspondence to be modified during machine operation.

In claim 10 of the present invention, the process model in claim 9 described above uses a normal distribution function as the cross direction profile response corresponding to the input manipulated variable. This empirically approximates profile responses well.

In claim 11 of the present invention, as the cross direction profile response in claim 10 described above, a dead time and a first order lag response are added to the normalized distribution function. This makes a model for a more realistic process.

In claim 12 of the present invention, as the above cross direction profile response in claim 11 described above, the following equation (2) is employed. This makes a model for a more realistic process.

$$\text{Profile response}=K\cdot g(n)\cdot U_j(n) \quad (2)$$

Where $$g(n) = 1 - \exp\left(-\frac{nT_0 - L}{T}\right) \quad (\text{when } nT_0 > L)$$

$$g(n) = 0 \quad (\text{when } nT_0 \le L)$$

In the above equation, "K" is a process gain, "n" is the number of sampling periods from inputting of the manipulated variable to outputting of its profile response, "$T_o$" is a sampling period, "L" is a dead time, "T" is the time constant of the first order lag, and "$U_j$(n)" is the manipulated variable input n sampling periods before.

In claim 13 of the present invention, the position correspondence optimization portion in any of claims 9 to 12 described above determines the above position correspondence modification amount using the steepest descent method. This enables the solution to be obtained simply and rapidly.

In claim 14 of the present invention, the position correspondence optimization portion in claim 13 described above interpolates the modification amount determined by the above steepest descent method with the interpolation calculation using a neural network. Dispersion of the position correspondence modification amount in the cross direction caused by the dispersion of the amount of control action can be smoothly interpolated.

In accordance with claim 15 of the present invention, in claim 13 described above, the specific limit values are set and the above modification amount is modified so that the above modification amount does not take a value outside the region within the limit values. This can give stability to the optimization.

In accordance with claim 16 of the present invention, in claim 14 described above, the specific limit values are set and the above modification amount is modified so that it does not take a value outside the region within the limit values. This can give stability to the optimization.

BRIEF DESCRIPTION OF THE DRAWINGS

FIG. 7 is a characteristic table indicating the effects of an embodiment of the present invention.

DESCRIPTION OF THE PREFERRED EMBODIMENT

The present invention will be described below in detail based on the drawings.

Figure 1:
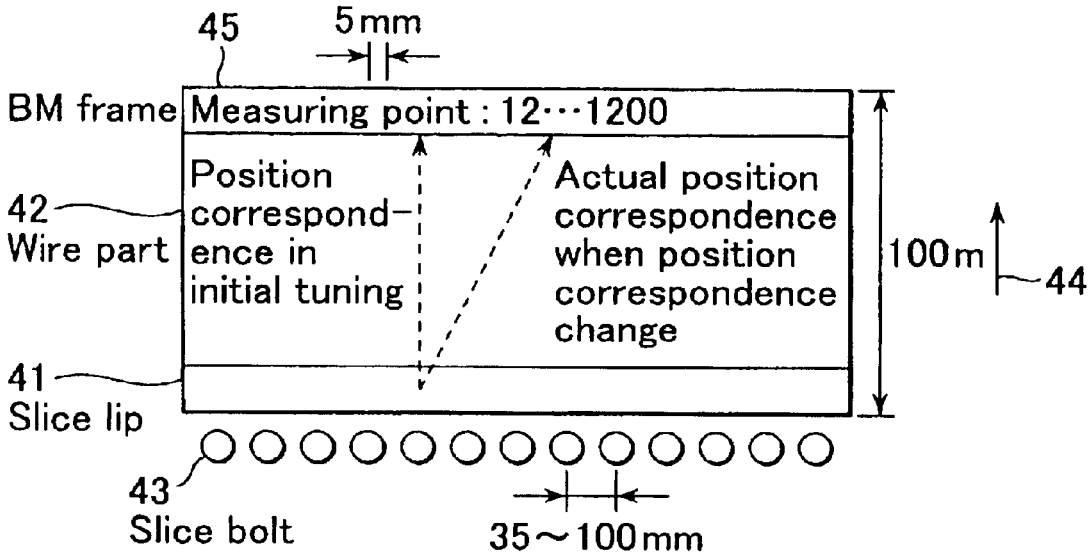
FIG.1 (Prior Art)
FIG. 1 is a configuration drawing showing the arrangement of actuators and measuring points.
Figure 2:
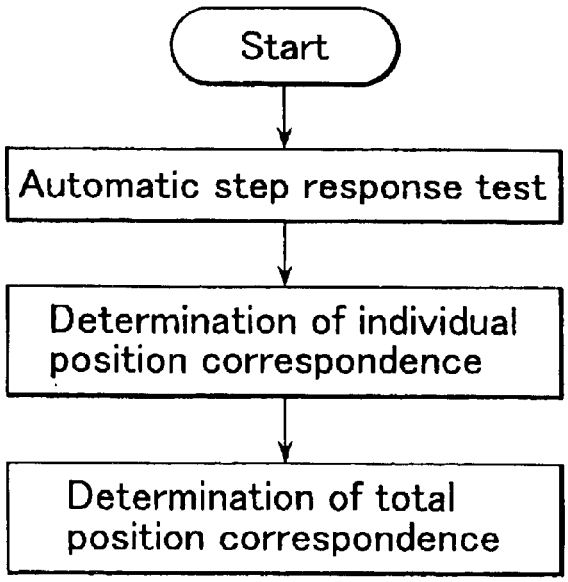
FIG.2 (Prior Art)
FIG. 2 is a flow chart indicating a conventional setting method for position correspondence.
Figure 3:
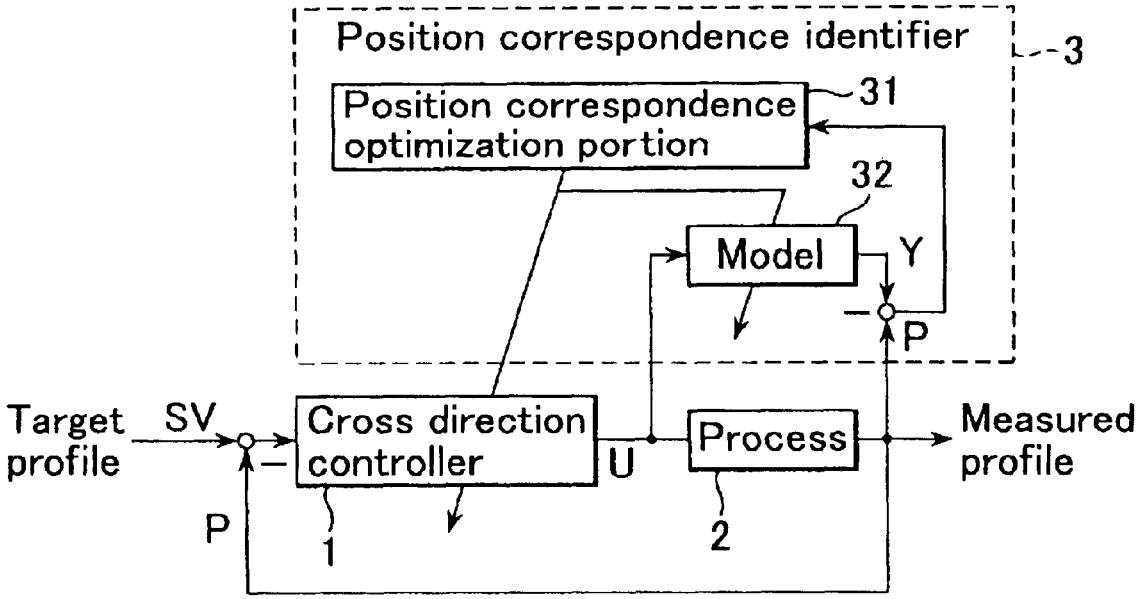
FIG. 3 is a configuration drawing indicating an embodiment of the present invention.

FIG. 3 is a configuration drawing indicating an embodiment of the present invention for manufacturing equipment for sheet form products. In FIG. 3, numeral 1 denotes a cross direction controller which receives a deviation between target profile SV and measured profile P as an input. Cross direction controller 1 calculates the optimum manipulated amount U from this deviation and outputs the amount U. Numeral 2 shows a process that produces sheet form products and receives a manipulated amount U as the input. Process 2 produces sheet form products as well as outputs a sheet's cross direction measured profile P.

Numeral 3 denotes a position correspondence identifier which is composed of position correspondence optimization portion 31 and model 32. Model 32 simulates process 2, receives manipulated amount U as the input and outputs profile response Y. The deviation between profile response Y and measured profile P output from process 2 is input to position correspondence optimization portion 31.

Position correspondence optimization portion 31 carries out optimization calculation on the position correspondence, interference width, and process gain from the deviation between input profile response Y and measured profile P to modify model 32, and also re-sets the position correspondence of cross direction controller 1.

Figure 4:
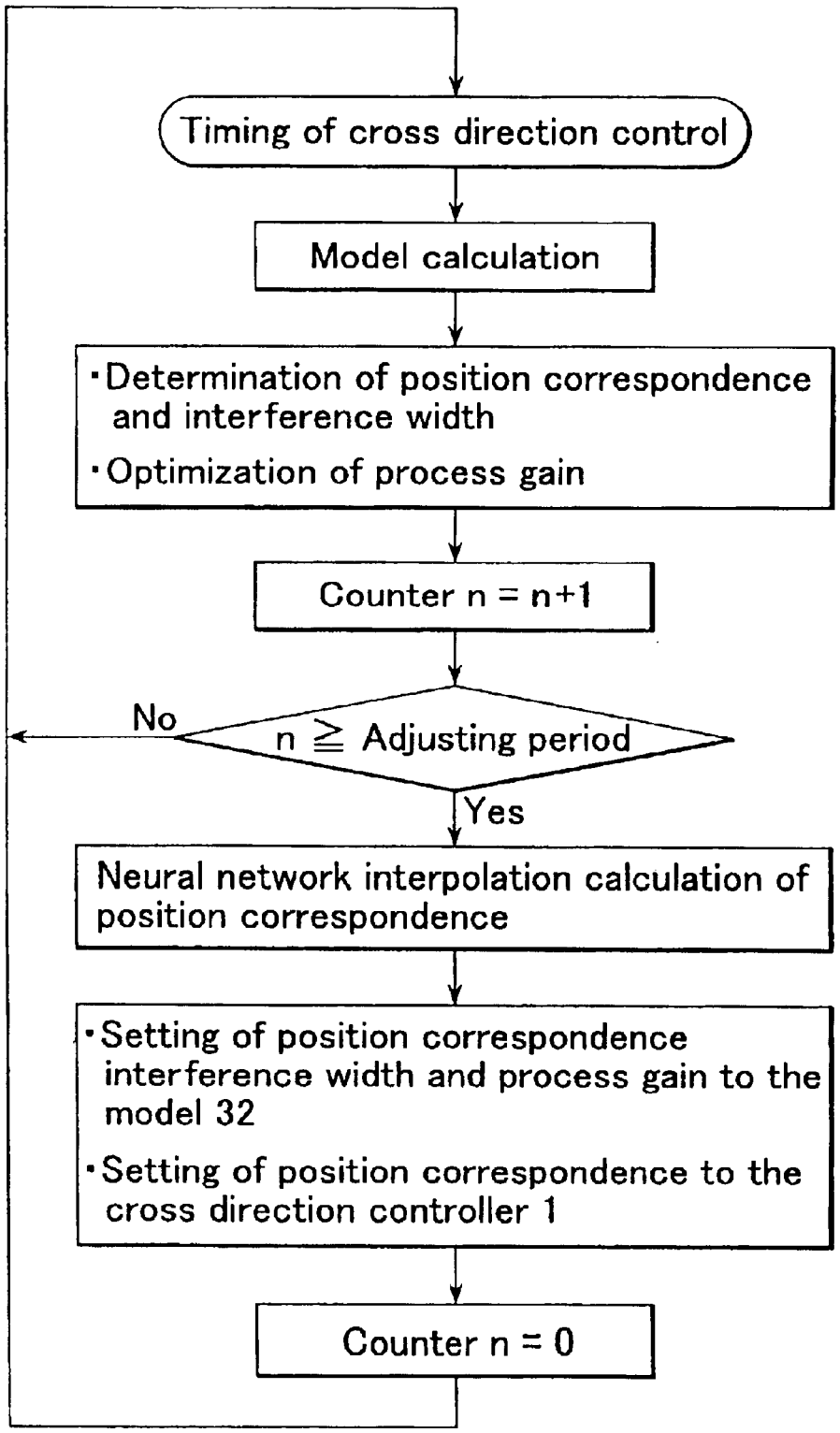
FIG. 4 is a flow chart indicating an embodiment of the present invention.

FIG. 4 is a flow chart indicating the action of position correspondence identifier 3. This flow is executed at each cross direction control timing. First, model calculation is implemented by model 32. Next, the position correspondence, interference width and process gain are optimized by position correspondence optimization portion 31.

Then the position correspondence, interference width and process gain are set to model 32 and the position correspondence is set to cross direction controller 1, and these settings are implemented for a longer period than the cross direction control timing. For this reason, counter n is incremented, and if a counted value is smaller than the predetermined adjusting period, model calculation is repeated after waiting for the next cross direction control timing.

If the counted value in counter n becomes larger than the predetermined adjusting period, position correspondence optimization portion 31 implements interpolation calculation to the optimized position correspondence using a neural network, and re-sets the interpolated position correspondence to model 32 and cross direction controller 1. Then position correspondence optimization portion 31 re-sets the interference width and process gain to model 32, and waits for the next cross direction control timing after resetting the counted value of counter n to 0 (zero).

Next, individual actions in the flow chart of FIG. 4 will be described in detail. To simplify the description, it is assumed that target profile SV=0 and measured profile P is equal to the deviation input to cross direction controller 1. It is also assumed that the number of actuator bolts is M and the number of profile measuring points in the cross direction is N.

First, model calculation will be described. Let the position correspondence for the j-th actuator be "m(j)." This "m(j)" represents a profile measuring point and actually takes any natural number from 1 to N. However, it is determined that any real number of $1 \leqq m(j) \leqq N$ can be taken by expanding the value region to real numbers. In addition, although a model for profile response to manipulated amount "$U_j$" of cross direction controller 1 corresponding to the j-th actuator is considered, it is assumed that a complete profile response can be obtained in one (1) sampling period neglecting the lag of response to the time base to simplify the description.

The profile response to manipulated amount "$U_j$" corresponding to the j-th actuator after one sampling period is represented by normalized distribution function "S(i; m(j), σ)" shown in equation (3) below, where the scale of the normal distribution function is normalized with the number of profile measuring points per single zone of the actuators N/M.

$$S(i; m(j), \sigma) = \frac{N}{M} \times \frac{1}{\sqrt{2\pi} \times \sigma} \exp\left(-\frac{(i - m(j))^2}{2\sigma^2}\right) \tag{3}$$

Figure 5:
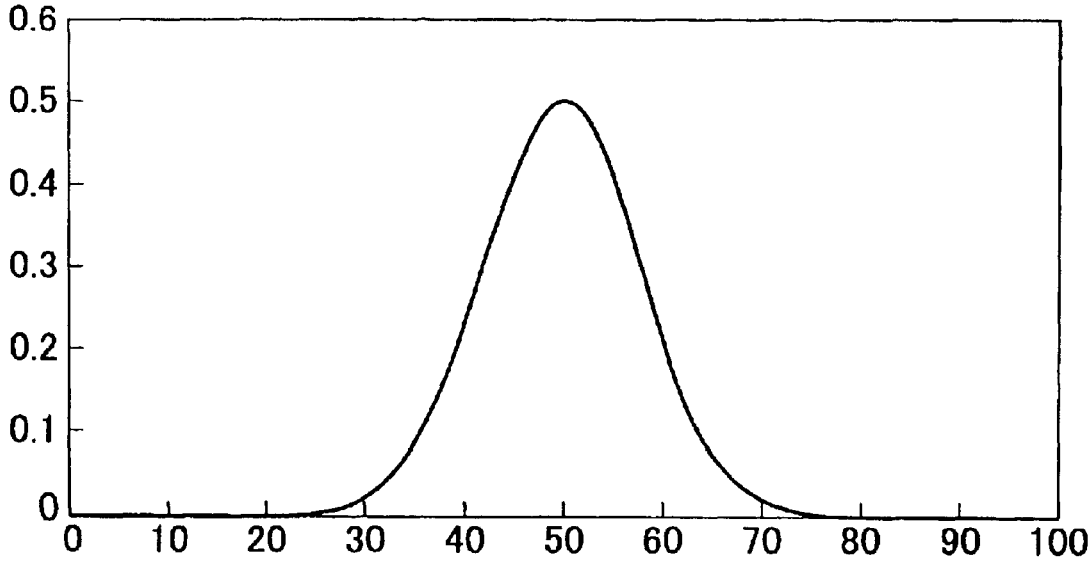
FIG. 5 is a characteristic diagram indicating an example of the normal distribution function.

FIG. 5 shows this normalized distribution function "S(i; m(j), σ)." In addition, the following values are taken: m(j)=50, σ=8, N=300, and M=30. This normalized distribution function empirically approximates the profile response well. It can be said that variance σ represents the magnitude of interference width in the cross direction.

If the normalized distribution function "S(i; m(j), σ)" in the above equation (3) is used, the model of profile response "Y(i)(i=1, . . . , N)" due to the manipulated amount "$U_j$(j=1, . . . , M)" can be represented with equation (4) below, $$Y(i) = K \sum_{j=1}^{M} (S(i; m(j), \sigma) \times U_j) \quad (i = 1, \ldots, N) \tag{4}$$

where "K" is a process gain.

If a profile does not respond by 100% in one sampling period, the model can be expanded as shown below. The profile response lag is basically determined by the lag in sheet travel from the actuators to the measuring points and low-pass filter provided in the measuring portion for the purpose of attenuating short period variations. In many cases, the first order filter is used as the low-pass filter.

Accordingly, this time lag can be simulated with a model having a system where a dead time is combined with a first order lag. This dead time and the time constant for the first order lag may be considered to be known values. If the sampling period is represented by "$T_o$," the dead time "L," and the time constant for the first order lag "T," the present time profile response can be represented by equation (5) shown below.

$$\text{Profile response}=K\cdot g(n)\cdot U_j(n) \tag{5}$$

Where $$g(n) = 1 - \exp\left(-\frac{nT_0 - L}{T}\right) \quad (\text{when } nT_0 > L)$$

$$g(n) = 0 \quad (\text{when } nT_0 \le L)$$

From equation (5), profile response including the cross direction "Y(i)" is represented by equation (6) below.

$$Y(i) = K\sum_{j=1}^{M}\left(S(i;m(j),\sigma)\cdot\sum_{n=1}^{N_0}\{(g(n)-g(n-1))\cdot U_j(n)\}\right) \tag{6}$$

where $$i = 1, \ldots, N$$

The total sum for "n" suffices if "n" is taken, for example, to the minimum "n" that satisfies the inequalities of $n\times T_o>L+2T$.

Next, optimization of the position correspondence, interference width and process gain is described. For profile response "Y(i)," either one that was used in the above equation (4) or that was used in equation (6) may be used.

If it is assumed that the profile response of actual process 2 is represented with "P(i)(i=1, . . . , N)," an error between actual process 2 and model 32 is represented by square deviation function "J" of equation (7) below.

$$J = \sum_{i=1}^{N}\{P(i)-Y(i)\}^2 = \sum_{i=1}^{N}\left\{P(i) - K\sum_{j=1}^{M}(S(i;m(j),\sigma)\times U_j)\right\}^2 \tag{7}$$

To carry out optimization, position correspondence "m(j)," interference width "σ" and process gain "K" for minimizing this "J" must be determined.

Now the optimized value is herein determined using the algorithm of the steepest descent method which is a well known optimization technique. First, to perform the determination, derivatives for each variable of normalized distribution function "S(i; m(j), σ)" are calculated using equations (8) to (10) below.

$$\begin{aligned}\frac{\partial S(i;m(j),\sigma)}{\partial m(j)} &= \frac{N}{M}\times\frac{1}{\sqrt{2\pi}\times\sigma}\times\frac{\partial}{\partial m(j)}\exp\left(-\frac{(i-m(j))^2}{2\sigma^2}\right)\\ &= \frac{N}{M}\times\frac{1}{\sqrt{2\pi}\times\sigma}\times\frac{(1-m(j))}{\sigma^2}\times\exp\left(-\frac{(i-m(j))^2}{2\sigma^2}\right)\\ &= \frac{(i-m(j))}{\sigma^2}\times S(i;m(j),\sigma)\end{aligned} \tag{8}$$

$$\frac{\partial S(i;m(j),\sigma)}{\partial\sigma} = \frac{(i-m(j))^2-\sigma^2}{\sigma^3}\times S(i;m(j),\sigma) \tag{9}$$

-continued $$\frac{\partial S(i;m(j),\sigma)}{\partial\sigma} = \frac{1}{K}\times S(i;m(j),\sigma) \tag{10}$$

Using the above equations (8) to (10), derivatives for each variable of square deviation function "J" are calculated by equations (11) to (13) below.

$$\frac{\partial J}{\partial m(j)} = -2U_j\sum_{j=1}^{N}\left[\frac{i-m(j)}{\sigma^2}\times S(i;m(j),\sigma)\times\left\{Y(i)-\sum_{k=1}^{M}(S(i;m(j),\sigma)\times U_k)\right\}\right] \quad (j=1,\ldots,M) \tag{11}$$

$$\frac{\partial J}{\partial\sigma} = -2\sum_{j=1}^{M}\left[U_j\sum_{i=1}^{N}\left[\frac{(i-m(j))^2-\sigma^2}{\sigma^3}\times S(i;m(j),\sigma)\times\left\{Y(i)-\sum_{k=1}^{M}(S(i;m(j),\sigma)\times U_k)\right\}\right]\right] \tag{12}$$

$$\frac{\partial J}{\partial K} = -\frac{2}{K}\sum_{j=1}^{M}\left[U_j\sum_{i=1}^{N}[S(i;m(j),\sigma)\times\left\{Y(i)-\sum_{k=1}^{M}(S(i;m(j),\sigma)\times U_k)\right\}\right]\right] \tag{13}$$

Using these equations (11) to (13), modification amounts for each variable "Δm(j)(j=1, . . . , M)," "Δσ," and "ΔK" after one step using the steepest descent method can be calculated using equations (14) to (16) below. Here, modification step widths for each variable are set as "Dm," "Dσ" and "DK."

$$\Delta m(j) \to \Delta m(j) - Dm\times\frac{\partial J}{\partial m(j)} \quad (j=1,\ldots,M) \tag{14}$$

$$\Delta\sigma \to \Delta\sigma - D\sigma\times\frac{\partial J}{\partial\sigma} \tag{15}$$

$$\Delta K \to \Delta K - DK\times\frac{\partial J}{\partial K} \tag{16}$$

Next, a neural network interpolation of position correspondence is described. Although the modification amounts "Δm(j)(j=1, . . . , M)" for each position correspondence "m(j)(j=1, . . . , M)" can be determined using the above equation (14), the following problem occurs only with this modification calculation. That is, although the model modification amount becomes large in a place where significant control action has been implemented or in a place where the profile deviation is large, the model modification amount becomes small in a place where control action is minimal, or in a place where the profile deviation is small even if there is a large deviation between the process and the model.

In other words, the modification amount is affected not only by the amount of deviation between the process and the model but also by the amount of control action. Thus, dispersion occurs in position correspondence modification amounts as a result. To solve this problem, an algorithm using a neural network is applied.

Figure 6:
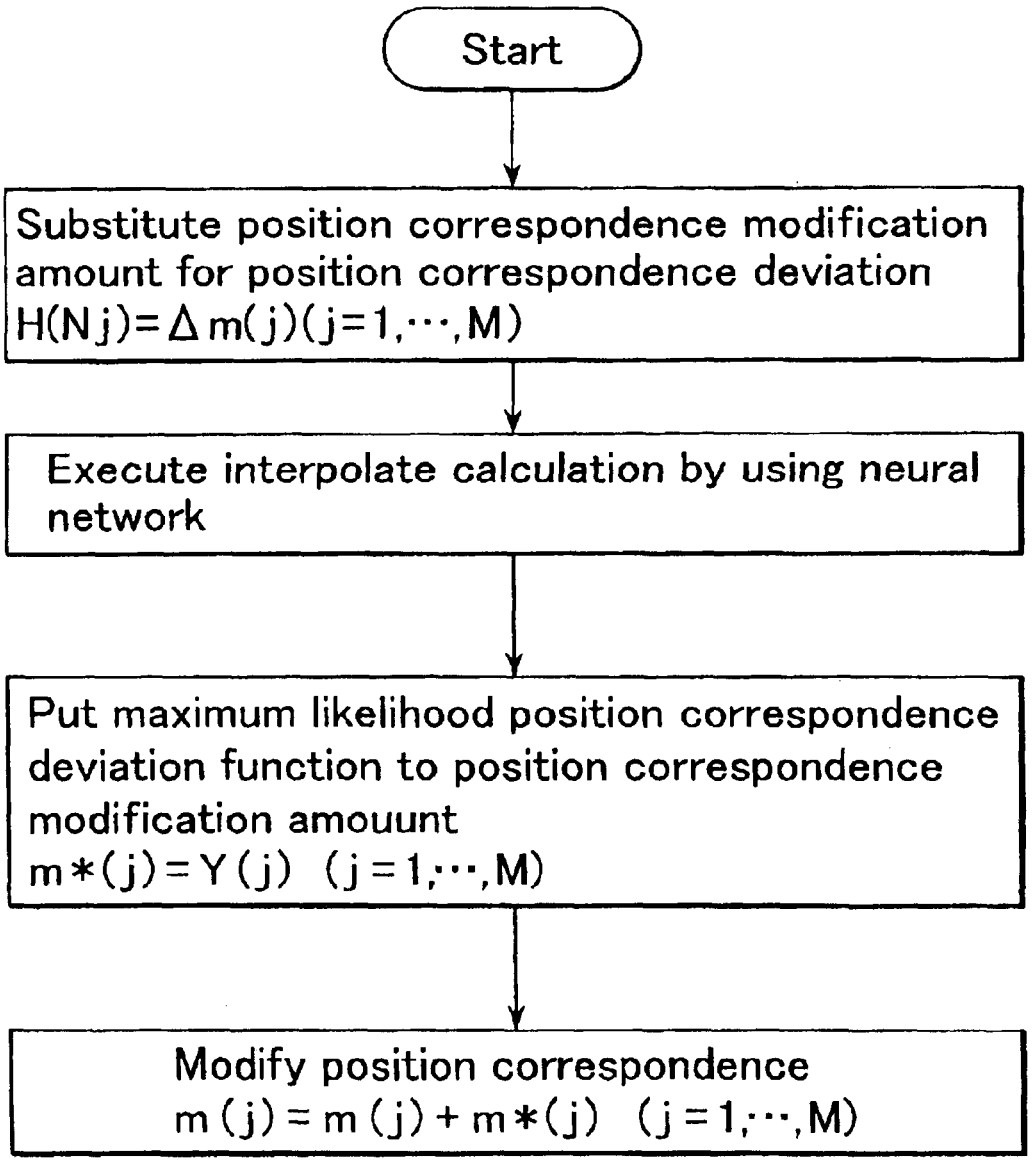
FIG. 6 is a flow chart indicating another embodiment of the present invention.

For the algorithm using a neural network, the invention mentioned in Japanese Laid-open Patent Application No. 9-132892 is used. FIG. 6 shows a flow of interpolation using a neural network. In FIG. 6, the interpolation calculation using a neural network is executed by substituting "Δm(j)"

determined with equation (14) given above for position correspondence deviation "H(Nj)." And the maximum likelihood position correspondence deviation function "Y(i)" obtained by this interpolation calculation is added to "m(j)," putting "Y(i)" to the use as position correspondence modification amount "Δm*(j)."

If it is assumed that the present time position correspondence in model 32 is "m(j)(j=1, . . . , M)," the position correspondence after modification is expressed as shown below.

$$m(j)=m(j)+m^*(j)$$

Since the maximum likelihood position correspondence deviation function "Y(i)" is a smoothly changing function as mentioned in Japanese Laid-open Patent Application No. 9-132892, position correspondence m(j) also changes smoothly.

Next, the updated position correspondence "m(j)," interference width "σ," and process gain "K" are set to model 32, then the updated position correspondence "m(j)" is approximated with integers and is set to cross direction controller 1. With these settings, abrupt changes should be avoided and limit values should be prepared for the modification amount which, to ensure stability in optimization, should not take a value outside the region within these limit values.

In detail, with the above described limit values of position correspondence modification amount "Δm*(j)" assumed to be ±mBand, "Δm*(j)" is fixed to +mBand if "Δm*(j)" is larger than +mBand and "Δm*(j)" is fixed to −mBand if "Δm*(j)" is smaller than −mBand. This position correspondence modification amount "Δm*(j)" is added to "m(j)." If these are represented as equations, equations (17) to (19) are obtained.

$$\Delta m^*(j)>\text{mBand}\rightarrow\Delta m^*(j)=\text{mBand} \quad (17)$$

$$\Delta m^*(j)<-\text{mBand}\rightarrow\Delta m^*(j)=-\text{mBand} \quad (18)$$

$$m(j)\rightarrow m(j)+\Delta m^*(j)(j=1, \ldots, M) \quad (19)$$

In addition, if these settings are to be set to cross direction controller 1, this must be carried out after "m(j)" is approximated with integers.

Limit values are also set for interference width modification amount "Δσ" and process gain modification amount "ΔK" in the same manner. With the limit values of interference width modification amount assumed to be ±σBand, the modification amount "Δσ" is fixed to +σBand if the modification amount is larger than +σBand, or the modification amount is fixed to −σBand if the modification amount is smaller than −σBand. This modification amount is added to interference width "σ." If these are represented as equations, equations (20) to (22) are obtained.

$$\Delta\sigma>\sigma\text{Band}\rightarrow\Delta\sigma=\sigma\text{Band} \quad (20)$$

$$\Delta\sigma<-\sigma\text{Band}\rightarrow\Delta\sigma=-\sigma\text{Band} \quad (21)$$

$$\sigma\rightarrow\sigma+\Delta\sigma \quad (22)$$

Also for the process gain, with the limit values of process gain modification amount assumed to be ±KBand similarly, the modification amount "ΔK" is fixed to +KBand if the modification amount is larger than +KBand, or the modification amount is fixed to −KBand if the modification amount is smaller than −KBand. This modification amount is added to process gain "K." If these are represented as equations, equations (23) to (25) are obtained.

$$\Delta K>\text{KBand}\rightarrow\Delta K=\text{KBand} \quad (23)$$

$$\Delta K<-\text{KBand}\rightarrow\Delta K=-\text{KBand} \quad (24)$$

$$K\rightarrow K+\Delta K \quad (25)$$

FIG. 7 shows the result of simulation for this embodiment. Each column of the table shown in FIG. 7 represents the actuator number, position correspondence output from model 32, position correspondence in actual process 2, difference between position correspondences in process 2 and model 32, and the position correspondence modification amount that is the output from position correspondence optimization portion 31 from the left respectively. Incidentally, the simulation is implemented by setting 30 as the actuator number, 300 as the number of profile measuring points, 200 as the number of control times, and 20 as the number of adjustments. The step width of position correspondence is 200.

As seen in FIG. 7, in almost all actuators, the difference between position correspondence in actual process 2 and position correspondence in model 32 agrees with the position correspondence modification amount within a range of error of 0.1. Accordingly, it is known that control can be performed by setting the values obtained by adding each position correspondence modification amount to the position correspondence in model 32 to the corresponding position correspondence in process 2.

Figures 8, 9:
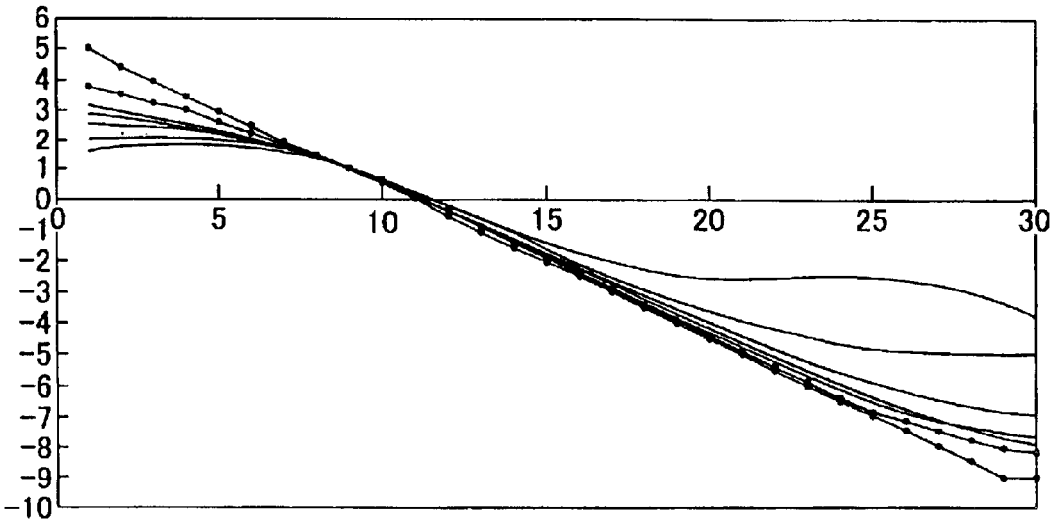
FIG. 8 is another characteristic table indicating the effects of an embodiment of the present invention.
FIG. 9 is a characteristic diagram indicating the effects of an embodiment of the present invention.

FIG. 8 shows the results of simulation of the interference width and process gain. The difference between the process interference width and the model interference width is 2 while the interference width modification amount is 1.737, and thus both briefly agree with each other. In addition, the difference between process gains in the actual process and in the model is 0.3 while the process gain modification amount is 0.272, and thus it is known that both values agree pretty well.

FIG. 9 shows a diagram of position correspondences plotted at timings for every twentieth control in the same simulation and the abscissa of the figure shows actuator numbers. The ▲ symbol represents the difference between position correspondences in process 2 and model 32 and the ■ symbol represents position correspondence modification amounts at 200 control times. It is known that both are in good agreement.

Figure 10:
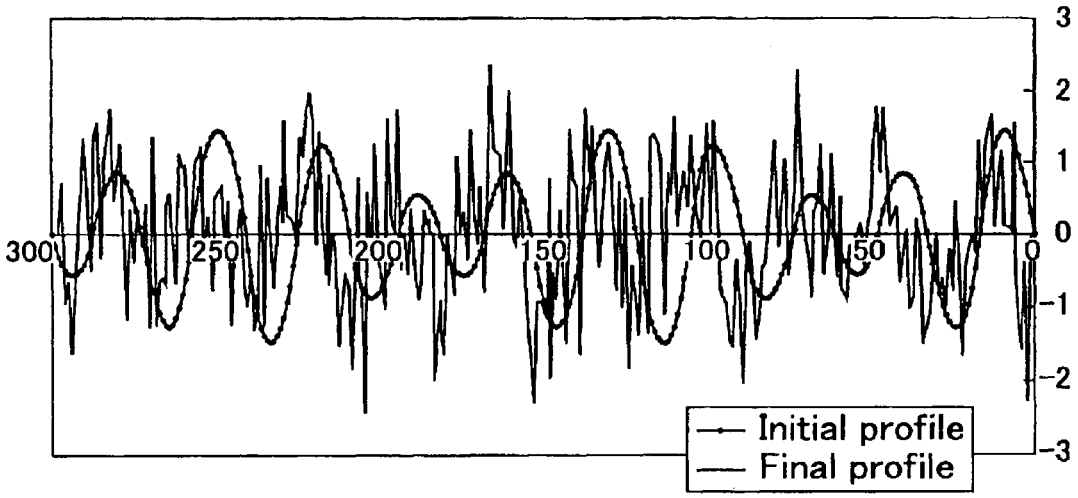
FIG. 10 is another characteristic diagram indicating the effects of an embodiment of the present invention.

FIG. 10 shows initial profiles and final profiles in the same simulation. The abscissa shows the measuring point numbers and the ● symbol represents the initial profile and only a single line represents the final profile. Although the final values contain noise because random noise having the amplitude of 0.2 is added at every control period, it is known that the initial values approximately agree with the final values.

Figure 11:
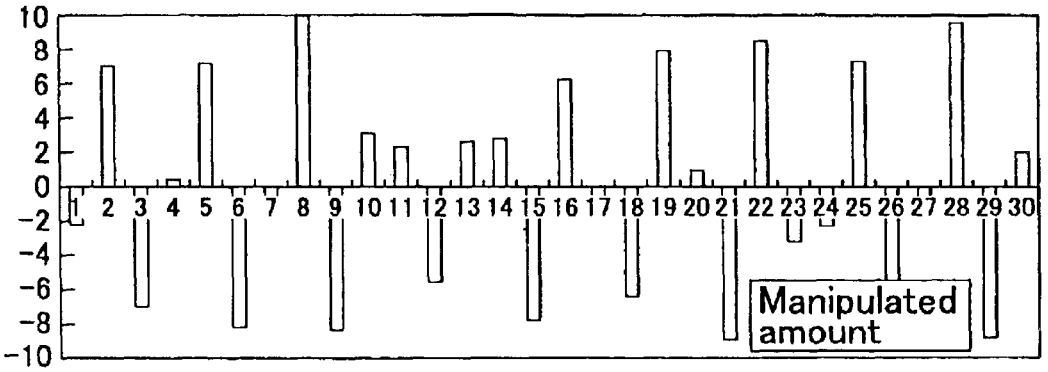
FIG. 11 is also another characteristic diagram indicating the effects of an embodiment of the present invention.

FIG. 11 is a graph showing manipulated amounts under these circumstances. The abscissa shows the actuator numbers. At actuators of numbers 1, 4, and 7, almost no manipulation is carried out because their manipulated amounts are small. However, it is known that the position correspondence is accurately identified.

In the meantime, although paper manufacturing equipment has been described in these embodiments, this method can be applied to other manufacturing equipment for sheet form products such as plastic film. Implementation of interpolation calculation using a neural network shown in FIG. 6 is not necessarily required.

As obvious from the above description, the following effects can be expected according to the present invention:

According to claim 1 of the present invention, an identification method for position correspondence is provided, which identifies the position correspondence between the actuators for controlling the cross direction profile and the measuring points for measuring the above profile in manufacturing equipment for sheet form products that includes a plurality of actuators for controlling cross direction profiles of sheet form products and a cross direction controller which receives a target profile and a measured profile in the cross direction of the above sheet form products as the inputs and sends out a manipulated variable that controls the above plurality of actuators. This method includes a step in which the manipulated variable sent out from the above cross direction controller is received and model calculation is carried out using a process model which simulates the process including the above plurality of actuators, a step in which the deviation between this model calculation output and the above measured profile is received and the optimum values for position correspondence, interference width, and process gain are calculated so that the above deviation is minimized, a step in which the resulting optimum values of position correspondence, interference width, and process gain are set to the position correspondence, interference width and process gain in the above process model, and a step in which the optimum value of the above position correspondence is set to the position correspondence in the above cross direction controller. The method is devised so that these settings are performed with the same timing as control in the above cross direction controller or for a longer period.

Since this equipment can modify position correspondence in succession during machine operation, there is the effect that controllability does not deteriorate even if machine operating conditions change. In addition, since there is no need to identify position correspondence by testing step response during machine operation, there is another effect that profile changes and the tremendous burden imposed on the tuning operators are eliminated. Further, there is another effect that it becomes unnecessary to take time and effort for measuring and switching position correspondences for each raw material recipe.

According to claim 2 of the present invention, the process model in claim 1 described above uses a normal distribution function as the cross direction profile response corresponding to the input manipulated variable. Since this empirically approximates profile responses well, there is the effect that a good control characteristic is obtained.

According to claim 3 of the present invention, as the cross direction profile response in claim 2 described above, a dead time and a first order lag response are added to the normalized distribution function. There is the effect that a better process model is obtained and controllability is improved.

According to claim 4 of the present invention, as the above cross direction profile response in claim 3 described above, the following equation (26) is employed. There is the effect that a better process model is obtained and controllability is improved.

$$\text{Profile response}=K\cdot g(n)\cdot U_j(n) \tag{26}$$

Where $$g(n) = 1 - \exp\left(-\frac{nT_0 - L}{T}\right) \quad (\text{when } nT_0 > L)$$

$$g(n) = 0 \quad (\text{when } nT_0 \le L)$$

In the above equation, "K" is a process gain, "n" is the number of sampling periods from inputting of the manipulated variable to outputting of its profile response, "$T_o$" is a sampling period, "L" is a dead time, "T" is the time constant of the first order lag, and "$U_j(n)$" is the manipulated variable input n sampling periods before.

According to claim 5 of the present invention, the above position correspondence optimization portion in any of claims 1 to 4 described above is devised to determine the above position correspondence modification amount using the steepest descent method. Since this is a frequently used method, there is the effect that position correspondence can be obtained accurately and in a short time.

According to claim 6 of the present invention, calculation of the above optimum value in claim 5 described above, is devised to interpolate the above position correspondence modification amount determined by the above steepest descent method with the interpolation calculation using a neural network. There is the effect that dispersion of the position correspondence modification amount in the cross direction caused by the dispersion of the amount of control action can be smoothly interpolated.

According to claim 7 of the present invention, in claim 5 described above, it is devised that the specific limit values are set and the above modification amount is modified so that the above modification amount does not take a value outside the region within the limit values. This can prevent position correspondence from changing abruptly and can give stability to the optimization.

According to claim 8 of the present invention, in claim 6 described above, it is devised that the specific limit values are set and the above modification amount is modified so that the above modification amount does not take a value outside the region within the limit values. This can prevent position correspondence from changing abruptly and can give stability to the optimization.

In accordance with claim 9 of the present invention, the proposed manufacturing equipment for sheet form products includes a plurality of actuators for controlling cross direction profiles of sheet form products, a cross direction controller which receives a target profile and a measured profile in the cross direction of the above sheet form products as the inputs and sends out a manipulated variable that controls the above plurality of actuators, a process model which receives the above manipulated variable as the input and simulates the process, and a position correspondence optimization portion to which the deviation between the output of the process model and the above described measured profile is input. This position correspondence optimization portion optimizes the position correspondence between the above plurality of actuators and the above plurality of measuring points that measures the above measured profile and also optimizes the interference width of the above process model, so that the deviation between the output of the above process model and the above measured profile is minimized. This position correspondence optimization portion is also devised to set the resulting position correspondence and interference width to the above process model, and set the above position correspondence to the above cross direction controller.

Since this equipment can modify position correspondence in succession during machine operation, there is the effect that controllability does not deteriorate even if machine operating conditions change. In addition, since there is no need to identify position correspondence by testing step response during machine operation, there is another effect that profile changes and the tremendous burden imposed on the tuning operators are eliminated. Further, there is another effect that it becomes unnecessary to take time and effort for switching position correspondences for each raw material recipe.

In accordance with claim 10 of the present invention, the above process model in claim 9 described above uses a normal distribution function as the cross direction profile response corresponding to the input manipulated variable. Since this empirically approximates profile responses well, it provides the effect that a good control characteristic is obtained.

In accordance with claim 11 of the present invention, as the cross direction profile response in claim 10 described above, a dead time and a first order lag response are added to the normalized distribution function. This has the effect of enabling a better process model to be obtained and improves controllability.

In accordance with claim 12 of the present invention, as the above cross direction profile response in claim 11 described above, the following equation (27) is employed. This has the effect of enabling a better process model to be obtained and improves controllability.

$$\text{Profile response}=K\cdot g(n)\cdot U_j(n) \tag{27}$$

Where $$g(n) = 1 - \exp\left(-\frac{nT_0 - L}{T}\right) \quad (\text{when } nT_0 > L)$$

$$g(n) = 0 \quad (\text{when } nT_0 \le L)$$

In the above equation, "K" is a process gain, "n" is the number of sampling periods from inputting of the manipulated variable to outputting of its profile response, "$T_o$" is a sampling period, "L" is a dead time, "T" is the time constant of the first order lag, and "$U_j$(n)" is the manipulated variable input n sampling periods before.

In accordance with claim 13 of the present invention, the position correspondence optimization portion mentioned in any of claims 9 to 12 described above is devised to determine the above position correspondence modification amount using the steepest descent method. Since this is a frequently used technique, this provides the effect that the position correspondence can be determined accurately in a short time.

In accordance with claim 14 of the present invention, the position correspondence optimization portion described in claim 13 is devised to interpolate the modification amount determined with the above steepest descent method with the interpolation calculation using a neural network. This provides the effect that dispersion of the position correspondence modification amount caused by dispersion of the amount of control action can be smoothly interpolated.

According to claim 15 of the present invention, in claim 13 described above, it is devised that the specific limit values are set and the above modification amount is modified so that it does not take a value outside the region within the limit values. This can prevent position correspondence from changing abruptly and give stability to the optimization.

According to claim 16 of the present invention, in claim 14 described above, it is devised that the specific limit values are set and the above modification amount is modified so that it does not take a value outside the region within the limit values. This can prevent position correspondence from changing abruptly and give stability to the optimization.

What is claimed is:

1. An identification method for position correspondence in the cross direction, which identifies the position correspondence between the actuators for controlling the cross direction profile and the measuring points for measuring said profile in manufacturing equipment for sheet form products that includes a plurality of actuators for controlling cross direction profiles of sheet form products and a cross direction controller which receives a target profile and a measured profile in the cross direction of said sheet form products as the inputs and sends out a manipulated variable that controls said plurality of actuators, including:

a step in which the manipulated variable sent out from said cross direction controller is received and model calculation is carried out using a process model which simulates the process including said plurality of actuators, a step in which the deviation between this model calculation output and said measured profile is received and the optimum values for position correspondence, interference width, and process gain are calculated so that said deviation is minimized, a step in which the resulting optimum values of position correspondence, interference width, and process gain are set to the position correspondence, interference width and process gain in said process model, and a step in which the optimum value of said position correspondence is set to the position correspondence in said cross direction controller;

and performing these settings with the same timing as control in said cross direction controller or for a longer period.

2. An identification method for position correspondence in the cross direction in accordance with claim 1, wherein said process model uses the normal distribution function as the cross direction profile response corresponding to the input manipulated variable.

3. An identification method for position correspondence in the cross direction in accordance with claim 2, wherein a dead time and a first order lag response are added to the normalized distribution function as said cross direction profile response.

4. An identification method for position correspondence in the cross direction in accordance with claim 3, wherein the following equation (28) is employed as said cross direction profile response;

$$\text{Profile response}=K\cdot g(n)\cdot U_j(n) \tag{28}$$

Where $$g(n) = 1 - \exp\left(-\frac{nT_0 - L}{T}\right) \quad (\text{when } nT_0 > L)$$

$$g(n) = 0 \quad (\text{when } nT_0 \le L)$$

In the above equation, "K" is a process gain, "n" is the number of sampling periods from inputting of the manipulated variable to outputting of its profile response, "$T_o$" is a sampling period, "L" is a dead time, "T" is the time constant of the first order lag, and "$U_j$(n)" is the manipulated variable input n sampling periods before.

5. An identification method for position correspondence in the cross direction in accordance with any of claims 1 to 4, wherein said position correspondence modification amount is determined using the steepest descent method for calculation of said optimum value.

6. An identification method for position correspondence in the cross direction in accordance with claim 5, wherein said position correspondence modification amount determined by said steepest descent method is interpolated with the interpolation calculation using a neural network for calculation of said optimum value.

7. An identification method for position correspondence in the cross direction in accordance with claim 5, wherein the specific limit values are set and said modification amount is modified so that said modification amount does not take a value outside the region within the limit values.

8. An identification method for position correspondence in the cross direction in accordance with claim 6, wherein the specific limit values are set and said modification amount is modified so that said modification amount does not take a value outside the region within the limit values.

9. Manufacturing equipment for sheet form products that includes:

a plurality of actuators for controlling cross direction profiles of sheet form products, a cross direction controller which receives a target profile and a measured profile in the cross direction of said sheet form products as the inputs and sends out a manipulated variable that controls said plurality of actuators, a process model which receives said manipulated variable as the input and simulates the process, and a position correspondence optimization portion to which the deviation between the output of the process model and said measured profile is input;

said position correspondence optimization portion optimizing the position correspondence between said plurality of actuators and said plurality of measuring points that measure said measured profile and also optimizing the interference width of said process model, so that the deviation between the output of said process model and said measured profile is minimized, then setting the resulting position correspondence and interference width to said process model, and also setting said position correspondence to said cross direction controller.

10. Manufacturing equipment for sheet form products in accordance with claim 9, wherein said process model uses the normal distribution function as the cross direction profile response corresponding to the input manipulated variables.

11. Manufacturing equipment for sheet form products in accordance with claim 10, wherein a dead time and a first order lag response are added to the normalized distribution function as said cross direction profile response.

12. Manufacturing equipment for sheet form products in accordance with claim 11, wherein the following equation (29) is used as said cross direction profile response:

$$\text{Profile response} = K \cdot g(n) \cdot U_j(n) \tag{29}$$

Where $$g(n) = 1 - \exp\left(-\frac{nT_0 - L}{T}\right) \quad (\text{when } nT_0 > L)$$

$$g(n) = 0 \quad (\text{when } nT_0 \le L)$$

where "K" is a process gain, "n" is the number of sampling periods from inputting of the manipulated variable to outputting of its profile response, "$T_o$" is a sampling period, "L" is a dead time, "T" is the time constant of the first order lag, and "$U_j(n)$" is the manipulated variable input n sampling periods before.

13. Manufacturing equipment for sheet form products in accordance with any of claims 9 to 12, wherein said position correspondence optimization portion determines said position correspondence modification amount using the steepest descent method.

14. Manufacturing equipment for sheet form products in accordance with claim 13, wherein said position correspondence optimization portion interpolates the modification amount determined by said deepest descent method using interpolation calculation employing a neural network.

15. Manufacturing equipment for sheet form products in accordance with claim 13, wherein the specific limit values are set and said modification amount is modified so that said modification amount does not take a value outside the region within these limit values.

16. Manufacturing equipment for sheet form products in accordance with claim 14, wherein the specific limit values are set and said modification amount is modified so that said modification amount does not take a value outside the region within these limit values.

* * * * *